US010156337B2

(12) United States Patent
Gloss et al.

(10) Patent No.: US 10,156,337 B2
(45) Date of Patent: Dec. 18, 2018

(54) LIGHT DEVICE, ESPECIALLY A SIGNAL LAMP, FOR MOTOR VEHICLES

(71) Applicant: Varroc Lighting Systems, s.r.o., Senov u Noveho Jicina (CZ)

(72) Inventors: Tomas Gloss, Vitkov (CZ); Jakub Hruska, Hlucin (CZ); Milan Stylarek, Mikulcice (CZ)

(73) Assignee: VARROC LIGHTING SYSTEMS, S.R.O., Suvorovova (CZ)

( * ) Notice: Subject to any disclaimer, the term of this patent is extended or adjusted under 35 U.S.C. 154(b) by 0 days.

(21) Appl. No.: 15/821,447

(22) Filed: Nov. 22, 2017

(65) Prior Publication Data

US 2018/0149331 A1 May 31, 2018

(30) Foreign Application Priority Data

Nov. 29, 2016 (CZ) ..... PV 2016-745

(51) Int. Cl.

| | |
|---|---|
| ***F21V 1/00*** | (2006.01) |
| ***F21S 43/37*** | (2018.01) |
| ***F21S 43/19*** | (2018.01) |
| ***F21S 43/20*** | (2018.01) |

(52) U.S. Cl.

CPC ..... *F21S 43/37* (2018.01); *F21S 43/195* (2018.01); *F21S 43/26* (2018.01)

(58) Field of Classification Search

USPC ..... 362/459–549

See application file for complete search history.

(56) References Cited

U.S. PATENT DOCUMENTS

2015/0062946 A1* 3/2015 Fukai ..... B60Q 1/26 362/516
2015/0300587 A1* 10/2015 Scheibner ..... F21S 41/24 362/520

FOREIGN PATENT DOCUMENTS

| | | | |
|---|---|---|---|
| EP | 0399506 | A2 | 11/1990 |
| EP | 1195624 | A2 | 10/2002 |
| EP | 2390137 | A1 | 11/2011 |
| JP | 2012030630 | A | 2/2012 |

(Continued)

OTHER PUBLICATIONS

Search Report from Corresponding Czech Application PV 2016-745 dated Aug. 15, 2017 (1 page).

*Primary Examiner* — Jamara Franklin
(74) *Attorney, Agent, or Firm* — Hovey Williams LLP

(57) ABSTRACT

The light device, especially a signal lamp, for motor vehicles comprises a carrier housing covered by a cover with a front light output surface, a lighting unit positioned within the carrier housing to emit light rays towards the light output surface, and a semi-permeable layer situated between the light output surface and the lighting unit. The device further comprises a partly transparent primary planar optical element positioned between the output light surface and the lighting unit, and a secondary planar optical element positioned between the primary planar optical element and the lighting unit. Generally, the secondary planar optical element comprises at least one non-transparent planar part and one or more partly transparent planar parts, which are arranged in such a way to create one or more areas on the surface of the secondary planar optical element that are at least partly permeable for light rays emitted by the lighting unit.

9 Claims, 4 Drawing Sheets

(56) References Cited

FOREIGN PATENT DOCUMENTS

| | | | |
|---|---|---|---|
| JP | 5295532 | B2 | 9/2013 |
| WO | 2016025982 | A1 | 2/2016 |

* cited by examiner

LIGHT DEVICE, ESPECIALLY A SIGNAL LAMP, FOR MOTOR VEHICLES

FIELD OF THE INVENTION

The invention relates to a light device, especially a signal lamp, for motor vehicles. The invention relates to a light device for motor vehicles adapted to produce spatial light effects or other designer light effects.

BACKGROUND INFORMATION

A lamp for motor vehicles typically contains multiple lighting units, wherein each of these lighting units provides a different light function or contributes to ensuring the required emission characteristic of the light trace. Individual lighting units are generally mounted in a shaped carrier housing, while each unit comprises at least one light source and other optical elements. The light source emits light rays and the optical elements represent a system of refractive and reflective surfaces and interfaces of optical environments that influence the direction of light rays within the creation of the output light trace.

Currently, a homogeneous or interesting appearance from the designer point of view is emphasized in the context of ensuring the light functions in light devices designed for motor vehicles, namely both during active lighting and in the off state. E.g. the document EP2390137 discloses a design wherein a three-dimensional appearance of the output light trace is achieved by a mirror tunnel in the lit up state, the appearance being produced by a multiple reflection of light rays between two mirror surfaces, the front mirror surface being semi-permeable and permitting a part of the light beam in the direction of the optical axis X. The use of a semi-permeable mirror is also known from the document US20150062946A1, where an organic electroluminescence diode of the OLED type is fitted with a semi-permeable mirror surface on its inner side. A part of the light rays passes through the OLED out of the light device, and a part of the light rays is directed into the inner space of the light device onto a mirror surface, which produces a multiple reflection in the form of a tunnel effect. A disadvantage of the above-mentioned designs is very low efficiency of the optical assembly, while a black appearance of the lamp in the off state is not possible as, e.g., in the case of mobile phones where after switching the backlight off the phone display is black with a mirror reflection on its external surface.

In the prior art, a great number of designs can be found that enable darkening of a light-emitting surface. E.g., the document EP0399506 discloses the use of the properties of special electrically controlled polymer dispersed liquid crystal (PDLC) films. A disadvantage of this design is the fact that the film is placed between two carrier plates, and such an arrangement restricts the spatial shape of the light emitting surface. In addition, the film is controlled by alternating voltage with the need of using a special power supply/inverter. Another disadvantage is the time required for switching from the transparent active state to the opaque inactive state. This time is relatively long with respect to the requirement to light up, e.g., the Stop function almost immediately. Using the SPD glass technology is also known from the prior art, which makes it possible to control the amount of light penetrating through a glass light-emitting surface during a short time period. Solutions using PDLC film or SPD glass known so far are also characterized by high production complexity and limited applicability in serial production in the art of the lighting technology of motor vehicles. The technology of hot plastic injection molding is commonly used in the art of lighting devices and the use of PDLC or SPD glass is demanding from the technological, design and financial point of view.

Another prior art solution consists in using an LCD display, described e.g. in the document WO 2016025982 A1. Again, its disadvantage is that this element requires active control by means of further electronic control devices as well as costly production if the display should follow the shape of the surface of the covering glass of the lamp.

SUMMARY OF THE INVENTION

The object of the present invention is to introduce a new design of a light device, especially a signal lamp, for motor vehicles with a front output light surface that would have an essentially homogeneous appearance for an external viewer in the off state, preferably a dark appearance—e g mahogany or black or of another, essentially homogeneous color. The light device must be relatively easy to produce, and easily applicable to serial production of lighting devices of motor vehicles. The light device must make it possible to use spatially shaped optical elements and/or to create spatially shaped light-emitting surfaces with the use of a relatively low output of the power supply. Also, switching of the light device from the active state to the inactive state must be achievable within a short moment.

The above-mentioned objects of the present invention are fulfilled by a light device, especially a signal lamp for motor vehicles in accordance with the invention, comprising a carrier housing covered by a cover with a front light output surface, a lighting means positioned in the carrier housing to emit light rays towards the light output surface, and a semi-permeable layer situated between the light output surface and the lighting means. The light device comprises a partly transparent primary planar optical element situated between the light output surface and the lighting means, and a secondary planar optical element situated between the primary planar optical element and the lighting means. The secondary planar optical element comprises at least one non-transparent planar part and one or more at least partly transparent planar parts, the non-transparent planar parts and transparent planar parts being arranged in such a way as to create one or more areas on the surface of the secondary planar optical element that will be at least partly permeable for light rays emitted by the lighting means.

In one of the embodiments of the present invention, the semi-permeable layer is a semi-permeable mirror.

In another of the embodiments, the semi-permeable layer is adapted to partly reflect light rays emitted by the lighting means.

In yet another embodiment, the lighting means comprises two lighting units that are separated, especially with a partition, to emit two different light beams directed to two different areas on the surface of the secondary planar optical element that are at least partly permeable for light rays. The lighting units and the respective areas assigned to them can be used to display different light functions.

In another of the embodiments, the primary planar optical element is fitted with a semi-permeable layer on its inner side facing the lighting means.

The primary planar optical element can be the cover or its part, wherein the cover is fitted with a semi-permeable layer on its inner side facing the lighting means.

The primary planar optical element and/or the secondary planar optical element are produced as one piece, which can be with the use of plastic injection molding.

The cover, primary planar optical element and secondary planar optical element can be arranged in parallel with respect to each other.

DESCRIPTION OF THE FIGURES

The invention will be clarified in a more detailed way with the use of its embodiment examples with references to attached drawings, where.

DESCRIPTION OF EXAMPLES OF EMBODIMENTS OF THE INVENTION

Figure 1:
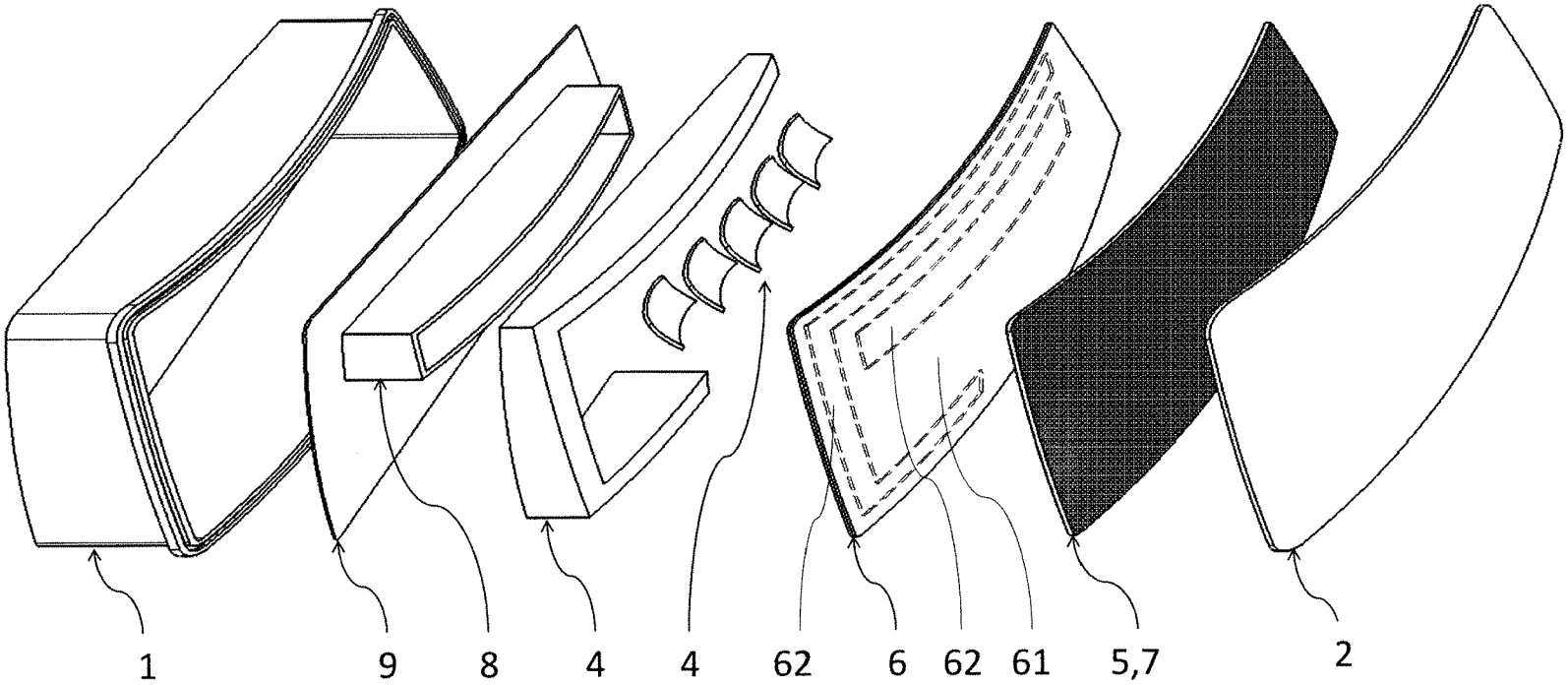
FIG. 1 shows an exploded axonometric view of the light device according to the invention.
Figure 2:
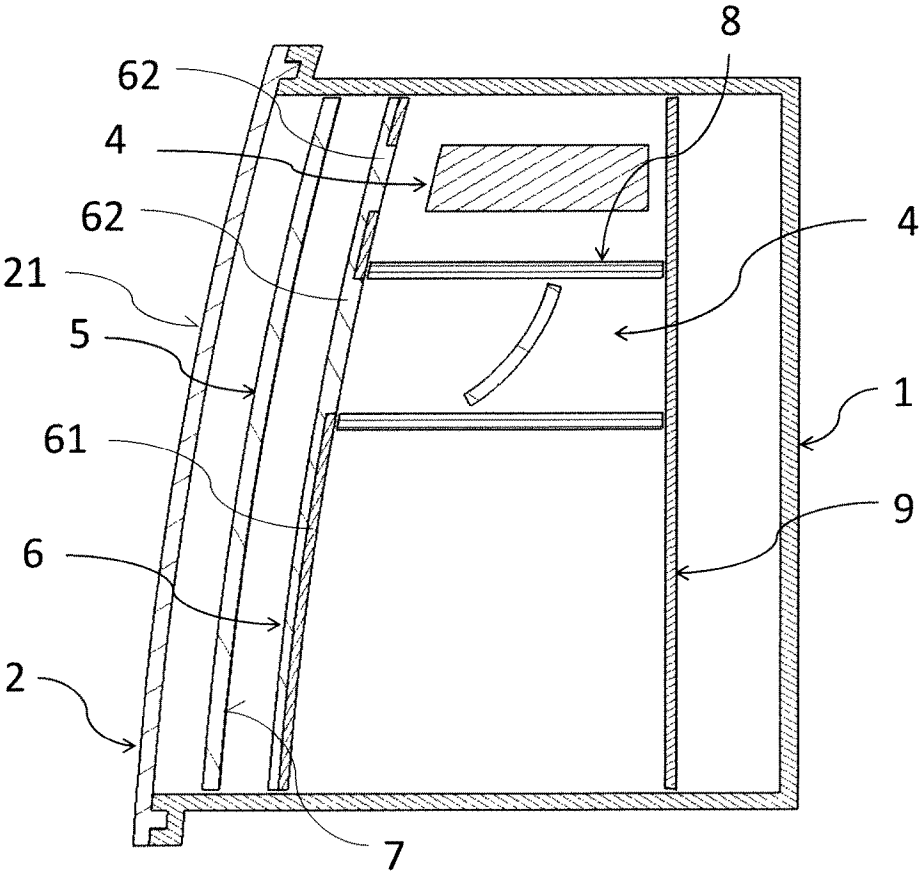
FIG. 2 shows a longitudinal cross-section through the light device according to the invention.

According to FIG. 1 and FIG. 2, the light device comprises a carrier housing 1 covered by a translucent cover 2, and an inner chamber where two lighting units 4 are mounted, either lighting unit 4 being adapted to emit light to ensure at least one light function. Between the cover 2 and the lighting units 4, the primary planar optical element 5 and the secondary planar optical element 6 are situated, which can be made of plastic.

The primary planar optical element 5, e.g. a filter, is designed as partly transparent and on its inner side facing the secondary planar optical element 6, it is fitted with a semi-permeable layer 7, e.g. in the form of a semi-permeable mirror. The secondary planar optical element 6 comprises a non-transparent part 61 creating an area without light functions, and two at least partly transparent parts 62 creating areas with light functions. In one embodiment, the secondary planar optical element 6 is made as one piece using the process of plastic injection molding, while in the view of the light device, a lighting unit 4 is situated behind the partly or completely transparent part 62 which is adapted to emit light towards the front light output surface 21. Individual lighting units 4 are mounted on a carrier 9 and are separated with a partition 8 to separate individual light rays 10, not shown here, or to eliminate parasitic light emitted from the other lighting unit 4.

Figure 3:
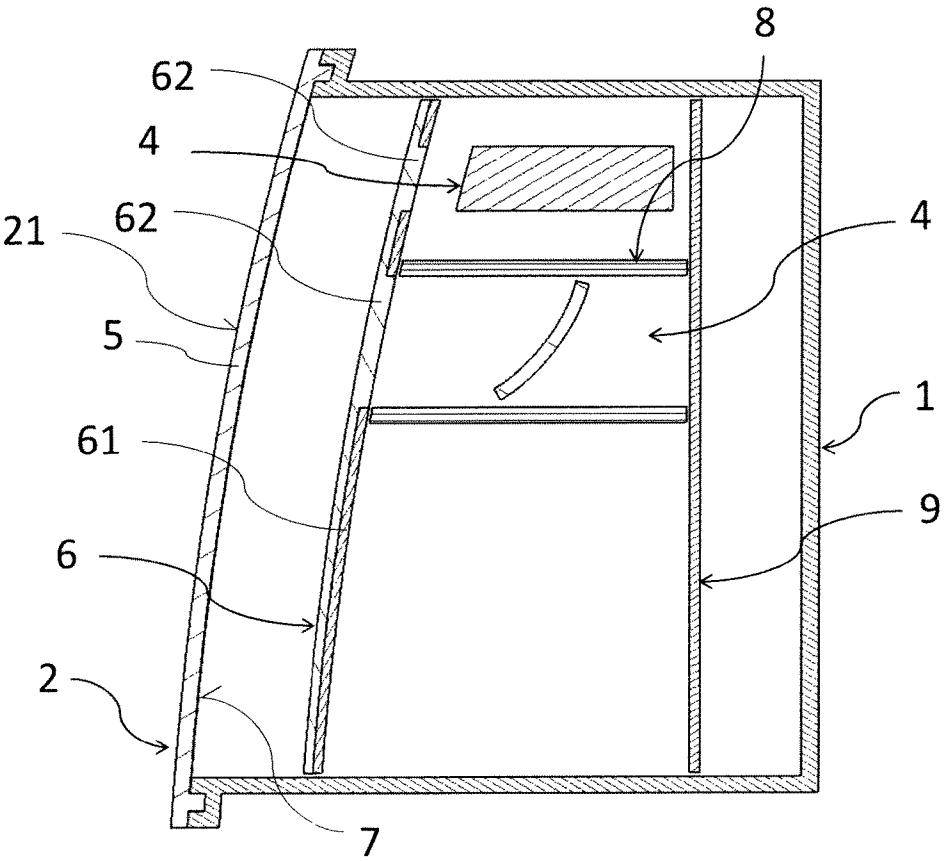
FIG. 3 shows a longitudinal cross-section through another embodiment example of the light device in accordance with the invention.

FIG. 3 shows a second embodiment example of the light device where the cover 2 is implemented as a partly transparent primary planar optical element 5, which is fitted with a semi-permeable layer 7 on the side facing the secondary planar optical element 6.

Figure 4:
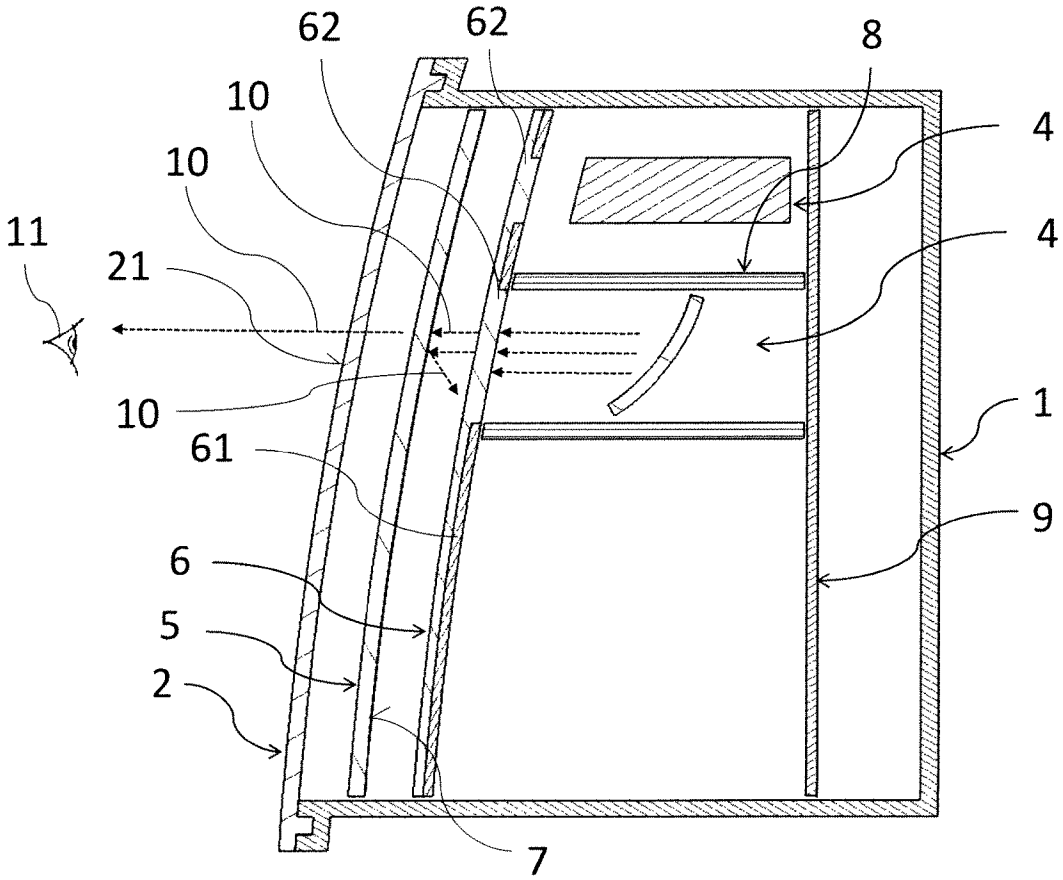
FIG. 4 shows a longitudinal cross-section through the light device of FIG. 2, indicating the propagation route of light rays.

FIG. 4 shows a longitudinal cross-section through the light device of FIG. 1, indicating the propagation route of light rays. As indicated, the lighting unit 4 emits light rays 10, a part of the light rays 10 passing through the partly or completely transparent part 62 of the secondary planar optical element 6 and falling onto the semi-permeable layer 7. A part of the light rays 10 passes through the semi-permeable layer 7 and partly transparent primary planar optical element 5. In one embodiment, a part of the light rays 10 passes through the translucent cover 2, implemented as a separate part, as well.

On deactivation of the lighting means, a substantially unicolored, homogeneous, preferably black/dark or mahogany appearance of the front light output surface 21 is produced for the external viewer 11, with possible mirror reflections of the external environment.

LIST OF REFERENCE MARKS

1—carrier housing
2—cover
4—lighting unit
5—primary planar optical element
6—secondary planar optical element
7—semipermeable layer
8—partition
9—carrier
10—light ray
11—viewer
21—front light output surface
61—non-transparent part
62—transparent part

What we claim as our invention is:

1. A light device comprising a carrier housing (1) covered by a cover (2) with a front light output surface (21), a lighting means positioned in the carrier housing (1) to emit light rays (10) towards the light output surface (21), and a semi-permeable layer (7) situated between the light output surface (21) and the lighting means, wherein the light device comprises a partly transparent primary planar optical element (5) situated between the light output surface (21) and the lighting means, and a secondary planar optical element (6) situated between the primary planar optical element (5) and the lighting means and comprising at least one non-transparent planar part (61) and one or more at least partly transparent planar parts (62), the at least one non-transparent planar part (61) and transparent planar parts (62) being arranged in such a way as to create one or more areas on the surface of the secondary planar optical element (6) that will be at least partly permeable for light rays (10) emitted by the lighting means.

2. The light device according to claim 1, wherein the semi-permeable layer (7) is a semi-permeable mirror.

3. The light device according to claim 1, wherein the semi-permeable layer (7) is adapted to partly reflect the light rays (10) emitted by the lighting means.

4. The light device according to claim 1, wherein the lighting means comprises two lighting units (4) that are separated, especially with a partition (8), to emit two different light beams directed to two different said areas that are at least partly permeable for the light rays (10).

5. The light device according to claim 4, wherein the lighting units (4) and the said areas assigned to them are used to display different light functions.

6. The light device according to claim 1, wherein the primary planar optical element (5) is fitted with a partly permeable layer (7) on its inner side facing the lighting means.

7. The light device according to claim 1, wherein the primary planar optical element (5) is the cover (2) or a part of the cover (2), wherein the cover (2) is fitted with a partly permeable layer (7) on its inner side facing the lighting means.

8. The light device according to claim 1, wherein the primary planar optical element (5), the secondary planar optical element (6), or the primary planar optical element (5)

and the secondary planar optical element (6) are each made as one integral piece, which can be by means of plastic injection molding.

9. The light device according to claim 1, wherein the cover (2), the primary planar optical element (5) and the secondary planar optical element (6) are arranged substantially parallel with respect to each other.

* * * * *